US008714449B2

(12) United States Patent
Jentoft

(10) Patent No.: US 8,714,449 B2
(45) Date of Patent: May 6, 2014

(54) METHOD AND DEVICE FOR ARMING AND DISARMING STATUS IN A FACILITY MONITORING SYSTEM

(75) Inventor: Keith A. Jentoft, Circle Pines, MN (US)

(73) Assignee: RSI Video Technologies, Inc., Vadnais Heights, MN (US)

( * ) Notice: Subject to any disclaimer, the term of this patent is extended or adjusted under 35 U.S.C. 154(b) by 585 days.

(21) Appl. No.: 12/367,141

(22) Filed: Feb. 6, 2009

(65) Prior Publication Data

US 2009/0200374 A1 Aug. 13, 2009

Related U.S. Application Data

(60) Provisional application No. 61/026,955, filed on Feb. 7, 2008.

(51) Int. Cl.

| | |
|---|---|
| ***G06F 17/00*** | (2006.01) |
| ***G06F 21/00*** | (2013.01) |
| ***G06K 5/00*** | (2006.01) |
| ***G06K 7/00*** | (2006.01) |
| ***G05B 19/00*** | (2006.01) |

(52) U.S. Cl.
USPC ..... 235/382; 235/375; 235/435; 713/185; 340/5.2; 340/5.21

(58) Field of Classification Search
USPC ..... 235/382, 375, 382.5, 435; 348/153; 340/5.2, 5.21; 713/185
See application file for complete search history.

(56) References Cited

U.S. PATENT DOCUMENTS

| | | | |
|---|---|---|---|
| 4,857,912 | A | 8/1989 | Everett, Jr. et al. |
| 5,237,330 | A | 8/1993 | Yaacov et al. |
| 5,448,290 | A | 9/1995 | VanZeeland |
| 5,515,029 | A | 5/1996 | Zhevelev et al. |
| 5,608,377 | A | 3/1997 | Zhevlev et al. |
| 5,661,471 | A | 8/1997 | Kotlicki |

(Continued)

FOREIGN PATENT DOCUMENTS

| | | | |
|---|---|---|---|
| DE | 101 50 745 | A 1 | 4/2003 |
| EP | 676 733 | A | 10/1995 |

(Continued)

OTHER PUBLICATIONS

U.S. Appl. No. 11/389,673, filed Mar. 24, 2006, Reibel.

(Continued)

*Primary Examiner* — Michael G Lee
*Assistant Examiner* — Laura Gudorf
(74) *Attorney, Agent, or Firm* — Crawford Maunu PLLC

(57) ABSTRACT

Security systems and methods are implemented using a variety of devices and methods. According to one such implementation, a controller arms or disarms a security system responsive to a contactless card reader. The contactless card reader includes a circuit for wirelessly interfacing with the controller, a battery circuit, and a sensor for detecting a contactless card. The card reader further includes a power-control circuit, responsive to the sensor, to control use of the battery circuit, and a coil for energizing the contactless card in response to the contactless card being detected by the sensor. The contactless card transmits data to the contactless card reader when the contactless card is energized. Responsive to the data transmitted by the contactless card, the contactless card reader wirelessly interfaces with the controller, which arms or disarms the security system based on the data transmitted by the card.

12 Claims, 5 Drawing Sheets

(56) References Cited

U.S. PATENT DOCUMENTS

| | | | | |
|---|---|---|---|---|
| 5,693,943 | A | 12/1997 | Tchernihovski et al. | |
| 5,703,368 | A | 12/1997 | Tomooka et al. | |
| 5,808,587 | A * | 9/1998 | Shima | 343/895 |
| 5,819,124 | A | 10/1998 | Somner et al. | |
| 5,832,758 | A | 11/1998 | White | |
| 6,037,902 | A | 3/2000 | Pinhas et al. | |
| 6,211,522 | B1 | 4/2001 | Kotlicki et al. | |
| 6,271,752 | B1 | 8/2001 | Vaios | |
| 6,411,209 | B1 | 6/2002 | Lyons et al. | |
| 6,462,652 | B1 * | 10/2002 | McCuen et al. | 340/501 |
| 6,476,858 | B1 | 11/2002 | Ramirez Diaz et al. | |
| 6,504,479 | B1 | 1/2003 | Lemons et al. | |
| 6,636,738 | B1 | 10/2003 | Hayashi | |
| 6,690,414 | B2 | 2/2004 | Lyons et al. | |
| 6,700,487 | B2 | 3/2004 | Lyons et al. | |
| 6,759,957 | B2 | 7/2004 | Murakami et al. | |
| 6,768,294 | B1 | 7/2004 | Moldavsky et al. | |
| 6,818,881 | B1 | 11/2004 | Chernichovski et al. | |
| 6,882,741 | B2 * | 4/2005 | Dobashi et al. | 382/118 |
| 6,933,846 | B2 | 8/2005 | Moldavsky et al. | |
| 6,965,313 | B1 | 11/2005 | Saylor et al. | |
| 6,970,183 | B1 | 11/2005 | Monroe | |
| 7,151,945 | B2 | 12/2006 | Myles et al. | |
| 7,170,998 | B2 * | 1/2007 | McLintock et al. | 380/277 |
| 7,228,429 | B2 * | 6/2007 | Monroe | 713/182 |
| 7,250,605 | B2 | 7/2007 | Zhevelev et al. | |
| 7,463,145 | B2 | 12/2008 | Jentoft | |
| 7,463,146 | B2 | 12/2008 | Reibel et al. | |
| 2002/0171557 | A1 | 11/2002 | Wegener | |
| 2003/0065407 | A1 | 4/2003 | Johnson et al. | |
| 2003/0193563 | A1 | 10/2003 | Suzuki | |
| 2003/0202117 | A1 | 10/2003 | Garner | |
| 2004/0109059 | A1 | 6/2004 | Kawakita | |
| 2004/0153671 | A1 * | 8/2004 | Schuyler et al. | 713/201 |
| 2004/0155781 | A1 | 8/2004 | DeOme | |
| 2004/0174247 | A1 * | 9/2004 | Rodenbeck et al. | 340/5.64 |
| 2004/0190467 | A1 | 9/2004 | Liu et al. | |
| 2004/0205823 | A1 | 10/2004 | Tsai | |
| 2004/0205824 | A1 | 10/2004 | Tsai | |
| 2004/0239497 | A1 | 12/2004 | Schwartzman et al. | |
| 2005/0024206 | A1 | 2/2005 | Samarasekera et al. | |
| 2005/0057649 | A1 * | 3/2005 | Marks | 348/143 |
| 2005/0134450 | A1 | 6/2005 | Kovach | |
| 2005/0134454 | A1 | 6/2005 | Eskildsen | |
| 2006/0219778 | A1 * | 10/2006 | Komatsu | 235/382 |
| 2007/0018106 | A1 | 1/2007 | Zhevelev et al. | |
| 2007/0029486 | A1 | 2/2007 | Zhevelev et al. | |
| 2008/0079561 | A1 | 4/2008 | Trundle et al. | |
| 2008/0258911 | A1 * | 10/2008 | Gray et al. | 340/540 |
| 2008/0265023 | A1 * | 10/2008 | Nassimi | 235/382 |
| 2008/0309449 | A1 | 12/2008 | Martin et al. | |
| 2009/0152352 | A1 * | 6/2009 | Hemmer et al. | 235/439 |

FOREIGN PATENT DOCUMENTS

| | | | |
|---|---|---|---|
| EP | 811 959 | A | 12/1997 |
| EP | 0 856 826 | A | 8/1998 |
| EP | 1 115 264 | A2 | 7/2001 |
| EP | 1 363 260 | A1 | 11/2003 |
| EP | 1 499 098 | A1 | 1/2005 |
| EP | 1 316 933 | B1 | 8/2006 |
| GB | 2 325 548 | A | 11/1998 |
| GB | 2 358 504 | A | 7/2001 |
| JP | 2003233889 | | 8/2003 |
| JP | 2005071064 | | 3/2005 |
| WO | WO 88/07474 | | 1/1988 |
| WO | WO 00/03367 | | 1/2000 |
| WO | WO 02/46919 | A2 | 6/2002 |
| WO | WO 2004/064355 | A2 | 7/2004 |
| WO | WO 2004/079684 | A1 | 9/2004 |
| WO | WO 2004/114648 | A2 | 12/2004 |
| WO | WO 2005/065196 | A2 | 7/2005 |
| WO | WO 2008/054479 | A2 | 5/2008 |

OTHER PUBLICATIONS

Csibi, S. et al. "Random Time and Frequency Hopping for Unslotted Asynchronous Access." IEEE 1996, p. 1123-1127.

* cited by examiner

METHOD AND DEVICE FOR ARMING AND DISARMING STATUS IN A FACILITY MONITORING SYSTEM

RELATED PATENT DOCUMENTS

This patent document claims the benefit, under 35 U.S.C. §119(e), of U.S. Provisional Patent Application Ser. No. 61/026,955 entitled "Method and Device for Arming and Disarming Status in a Facility Monitoring System" and filed on Feb. 7, 2008, which is fully incorporated herein by reference.

FIELD OF THE INVENTION

The present invention is directed to a method and device for arming and disarming a security system that monitors a secured area and, more specifically, to a method and device using a contactless card reader that wirelessly communicates with the security system.

BACKGROUND

A variety of applications benefit from protection of residents, employees, personal property, and the like, by using security monitoring systems within facilities, e.g., to monitor and/or sense certain conditions such as a facility-operations problem or the presence of an unwanted intruder. Many such security systems are connected to a central control unit and monitored by an operator who can alert the appropriate emergency services in the event of an unwanted intruder. Such security systems often include a combination of sensing devices and alarm devices and some also include cameras. To achieve the maximum monitoring coverage, these devices are distributed throughout the secured area.

These types of security systems also include a mechanism for arming/disarming the system in order to allow authorized users access to the secured area. For example, a key pad that allows a user to enter a code to disarm the system or some type of remote control device that communicates with the central control unit. A key pad (or a similar type of device) is typically located near the perimeter of the secured area. For example, it can be mounted on a fence surrounding the secured area or on the outside wall of a building that is protected by the security system. The installation of these keypads typically requires wiring to be run to the desired location for power and communication with the central control unit. Such installation can involve significant time and expense. These key pads are also usually located outside which requires them to be made weatherproof.

The above-discussed issues, as well as others, have presented challenges to providing access control devices for arming/disarming a security system, which can be quickly and efficiently installed in a desired location.

SUMMARY

The present invention is directed to the above and related types of integrated security devices. These and other aspects of the present invention are exemplified in a number of illustrated implementations and applications, some of which are shown in the figures and characterized in the claims section that follows.

According to one embodiment of the present invention, a security system uses a controller to communicate with security-monitoring devices and with a contactless card reader. The contactless card reader includes a circuit for wirelessly interfacing with the controller, a battery circuit, and a sensor for detecting the presence of a contactless card. The card reader further includes a power-control circuit, responsive to the sensor, to control use of the battery circuit, and an internal coil for energizing a coil of the contactless card in response to the contactless card being detected by the sensor. The contactless card transmits data to the contactless card reader when the coil of the contactless card is energized. Responsive to the data transmitted by the contactless card, the contactless card reader wirelessly interfaces with the controller, which arms or disarms the security system based on the data transmitted by the card.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the detailed description of various embodiments of the invention in connection with the accompanying drawings, in which.

Figure 1:
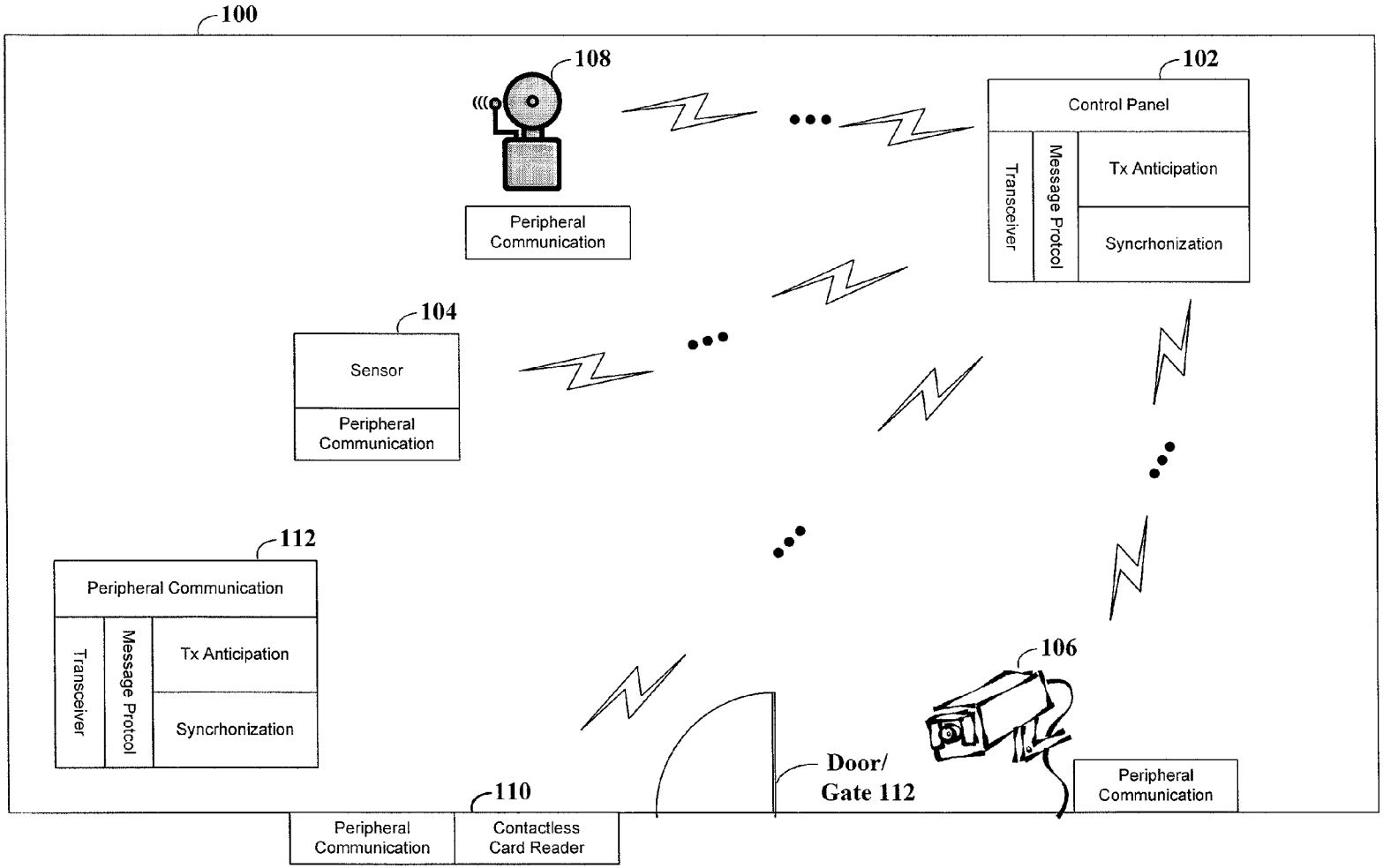
FIG. 1 shows a security system, according to an example embodiment of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of different approaches for, and arrangements used in, arming/disarming a security system. The invention has been found to be particularly advantageous for addressing security-monitoring applications in which a battery powered contactless card reader is used to arm/disarm the security system. While the present invention is not necessarily so limited, such a security-monitoring application is used in the following discussion to exemplify certain embodiments of the present invention.

According to an example embodiment of the present invention, a contactless card reader is used to arm/disarm a security system that uses a controller to communicate with security-monitoring devices. The contactless card reader includes a circuit for wirelessly interfacing with the controller, which arms/disarms the security system. The contactless card reader also includes a battery circuit, a sensor that detects the presence of a contactless card, and a power-control circuit, responsive to the sensor, that controls use of the battery circuit. The power control circuit responds to various control signals and acts to reduce the power consumption of the card reader. For example, the card reader is activated in response to a contactless card being placed in close proximity to the contactless card reader (i.e., the sensor detects the presence of the card and the card reader is activated). This is particularly useful for implementing a self-powered card reader that operates for extended periods of time without replacing, recharging or otherwise supplementing power to the card reader.

The contactless card reader further includes a circuit for energizing the contactless card in response to the contactless card being detected by the sensor, thereby prompting the contactless card to transmit data to the contactless card reader. Contactless energizing of the contactless card by the contactless card reader can be performed using various wireless techniques involving passive communication from the card, for example inductive coupling, RFID technology, and near field communication, or active communication from the card, for example IR communication, RF communication, optical communication, and acoustic communication. In certain embodiments, the contactless card reader includes an antenna/coil that inductively couples to an antenna/coil of a contactless card to energize the card.

The energized contactless card transmits data, which is received by the contactless card reader. In one implementation, the data transmitted by the card is a unique identification code that identifies the user of the card. The identification code transmitted by the card is then verified in order to determine whether the user of the card is authorized to arm/disarm the security system. In one implementation, the card reader wirelessly sends the data transmitted by the card to the controller, which performed the verification and determines whether to arm/disarm the security system. In another implementation, the card reader performs verification of the data transmitted by the card. If the card reader determines that the user of the card is an authorized user, then the card reader wirelessly transmits a signal to the controller indicating that the security system should be armed or disarmed. The card reader can include a memory that is used to store identification codes that correspond to authorized users. The card reader compares the identification code transmitted by the card with the codes stored in its memory to verify whether the person is authorized to arm/disarm the security system.

The contactless card reader of the present invention is particularly useful in applications where the running of power and communication wires is undesirable. For example, the contactless card reader can be mounted directly on a fence surrounding a secured area without the need to run any wires to the card reader. The contactless card reader wirelessly interfaces with the security system thereby enabling access control and arming/disarming of the system. In one implementation, the contactless card reader allows for quick and low cost installations of access control and arming/disarming stations.

In another implementation, the card reader transmits status and/or other information to the controller. For example, the card reader can store a log of access requests, which can be transmitted to the controller at predetermined intervals or in response to a request from the controller. The card reader can also transmit battery status information to the controller. For example, the card reader can transmit a signal to the controller when the power level of its battery drops below a certain level.

Consistent with the above discussed applications, FIG. 1 depicts a security system that includes a contactless card reader according to an example embodiment of the present invention, as might be useful for monitoring a secured area. FIG. 1 includes secured area 100, control panel 102, and peripheral devices 104-110. The security system is implemented in such a manner so as to reduce the power consumption of one or more of the control panel 102 and the peripheral devices 104-110 as related to the wireless communications between the devices. When implementing the wireless communications, the devices use multiple frequencies (channels) as well as communication intervals. The devices are able to reduce the power consumption by utilizing information regarding a specific frequency from the multiple frequencies used and the communication interval. For example, if the transmitting devices modify their transmissions based upon the information, a receiving device may reduce the power consumption by decreasing the time the receiving device is listening for a transmission from another device. By reducing the power consumption, the system lends itself to implementing bi-directional communications between the devices, which typically require more power consumption than unidirectional communications.

The jagged lines and ellipses found between the control panel 102 and the peripheral devices 104-110 represent wireless communications between the control panel and the peripheral devices. The wireless communications may be implemented using suitable frequencies. For instance, wireless communications frequencies in industrial, scientific and medical (ISM) radio bands (900 MHz, 2.4 GHz and 5.8 GHz) have been found to be suitable for security systems; however, alternate frequencies may be implemented in accordance with the particulars of the system or its intended implementation. For example implementations related to communicative coupling and data transfer among the above-discussed devices in accordance with appropriate protocols, reference may be made to U.S. patent application Ser. No. 11/389,673 filed on Mar. 24, 2006, and issued as U.S. Pat. No. 7,835,343, and to European Patent Application Publication No. EP 1 363 260 filed on May 6, 2003, entitled "Procédé De Communication Radiofréquence Entre Plusieurs Dispositifs Et Systéme De Surveillance Mettant En Oeuvre Un Tel Procédé," which are herein fully incorporated by reference.

The various elements of the peripheral devices 104-110 and the control panel 102 are implemented using one or more of electric circuit arrangements, processors, memory elements, software code, programmable logic devices, input/output interfaces or combinations thereof. In alternative (more specific) embodiments, the embodiments disclosed herein are implemented in combination with the embodiments described in the U.S. application Ser. No. 11/388,764, entitled "Security Monitoring Arrangement And Method Using A Common Field Of View," filed on Mar. 24, 2006 and issued as U.S. Pat. No. 7,463,145, which is fully incorporated herein by reference.

Secured area 100 represents a facility for which the security system is implemented. Common implementations of secured area 100 include, but are not limited to, a fenced-in enclosure such as an electrical substation, residential homes, retail stores, office buildings, government buildings, museums and other facilities. Typically, the security system will monitor several locations of secured area 100. Accordingly, FIG. 1 depicts various peripheral devices throughout the building.

Peripheral communications devices 104-110 may take the form of various different devices, a few of which are depicted in FIG. 1. For instance, device 104 depicts a sensor that may, among other things, detect motion within the secured area 100; device 106 depicts a camera for video capture; device 108 depicts an alarm; and device 110 depicts a contactless card reader as discussed above for interfacing with the control panel 102. These peripheral devices 104-110 communicate with control panel 102 using wireless communications.

Block 112 depicts several elements that may be implemented in the peripheral devices 104-110, including a transceiver block, a message protocol block, a synchronization block and a transmit (Tx) anticipation block. Various embodiments of the present invention use one or more of these blocks. In one such embodiment, a peripheral device wirelessly transmits a signal using the transceiver block. The peripheral device uses information regarding a transmission period and the listening channel of the control panel in the transmission process.

In one embodiment, the peripheral devices 104-110 transmit building security information to the control panel 102. For instance, device 106 might transmit video images or device-status information to the control panel 102, while device 110 might transmit information relating to arming/disarming the security system. In one implementation, the control panel triggers a relay to unlock and/or open door/gate 112 in response to contactless card reader 110 indicating that the security system should be disarmed.

FIG. 1 depicts control panel 102 as including a transceiver block, a message protocol block, a synchronization block and a transmit (Tx) anticipation block. Various embodiments of the present invention use one or more of these blocks. In one such embodiment, the transceiver block is used for receiving signals from one of the peripheral devices 104-110 as a function of the communication intervals and the frequency the control panel 102 uses to listen for transmissions. The listening frequency is one of several potential frequencies available for communication between the peripheral devices and the control panel. For instance, the system may use a number of contiguous frequency slots (channels) within a suitable frequency band. One example of such a use includes 25 or more channels within the ISM frequency band from 902-928 MHz. Numerous other combinations of channels and frequency bands are possible using the present invention.

Typically, the control panel and peripherals are implemented using a similar set of elements as depicted by blocks 102 and 112; however, various components may be implemented differently. For instance, the synchronization block can be implemented differently in the control panel versus the peripheral devices where the control panel provides synchronization information to each of the peripherals and the peripherals must use the synchronization information to maintain synchronization using a local clock. In such an instance, the peripherals would compare the synchronization information with the local clock in order to compensate for any difference between the peripherals' time frames and the control panel's time frame.

The control panel 102 and the peripheral blocks 104-110 are depicted as having a transceiver; however, the system may be implemented using variations of receivers and transmitters. In some instances, the control panel may be implemented with only a receiver and the peripherals with only a transmitter. In other instances, the control panel may be implemented with only a transmitter, while the peripherals are implemented with only a receiver. Other implementations allow for one or more of the control panels and peripherals to have both a transmitter and receiver (transceiver). Thus, transceiver is used herein to describe a receiver, transmitter or both a receiver and transmitter.

In another embodiment, a camera (such as device 106) is positioned to capture an image of a person who attempts to aim/disarm the security system using contactless card reader 110. The card reader 110 transmits the identification code of the contactless card used by a person to control panel 102. The control panel 102 determines whether the identification code of the card matches that of an authorized user and the control panel instructs camera 106 to capture an image of the person at card reader 110. The camera 106 transmits the captured image to control panel 102, which compares the captured image to an image of the authorized user associated with that contactless card. The control panel arms/disarms the security system if the captured image matches the image of the authorized user associated with that contactless card.

In a further embodiment, the security system includes at least one peripheral device that is a monitoring device that includes an integrated motion detector and an image-capture device. For further information regarding devices that include an integrated motion detector and image-capture device, reference may be made to U.S. application Ser. No. 11/687,991 filed on Mar. 19, 2007 and issued as U.S. Pat. No. 7,463,146, entitled "Integrated Motion-Image Monitoring Method And Device," which is herein fully incorporated by reference. The skilled artisan would appreciate that the contactless card reader 210, the contactless card 220, and related aspects can be used independently or as part of the systems described in U.S. Pat. No. 7,463,146.

Figure 2:
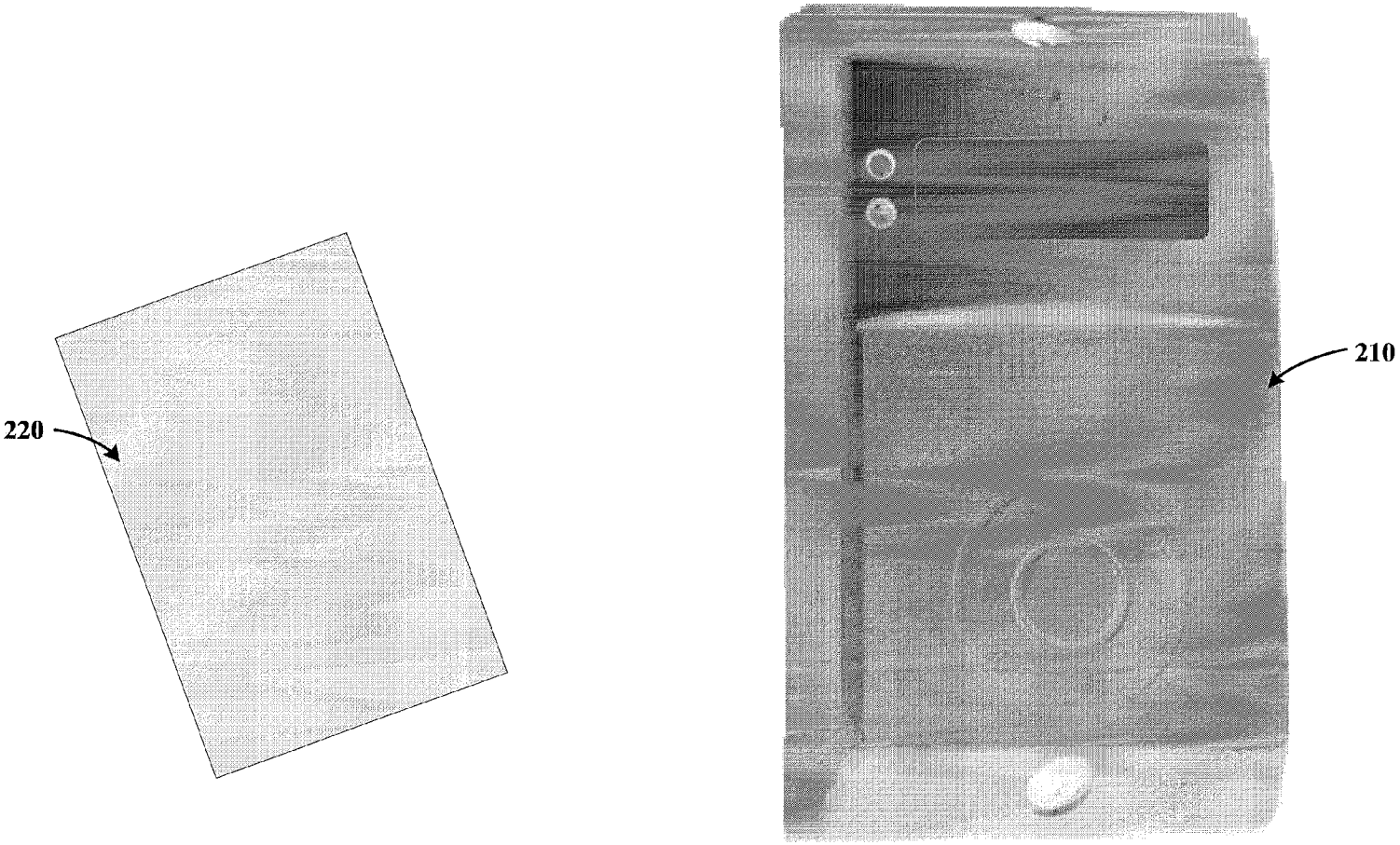
FIG. 2 illustrates a contactless card reader with a contactless card, according to an example embodiment of the present invention.

FIG. 2 illustrates a contactless card reader 210 and a contactless card 220, according to an example embodiment of the present invention.

Figure 3:
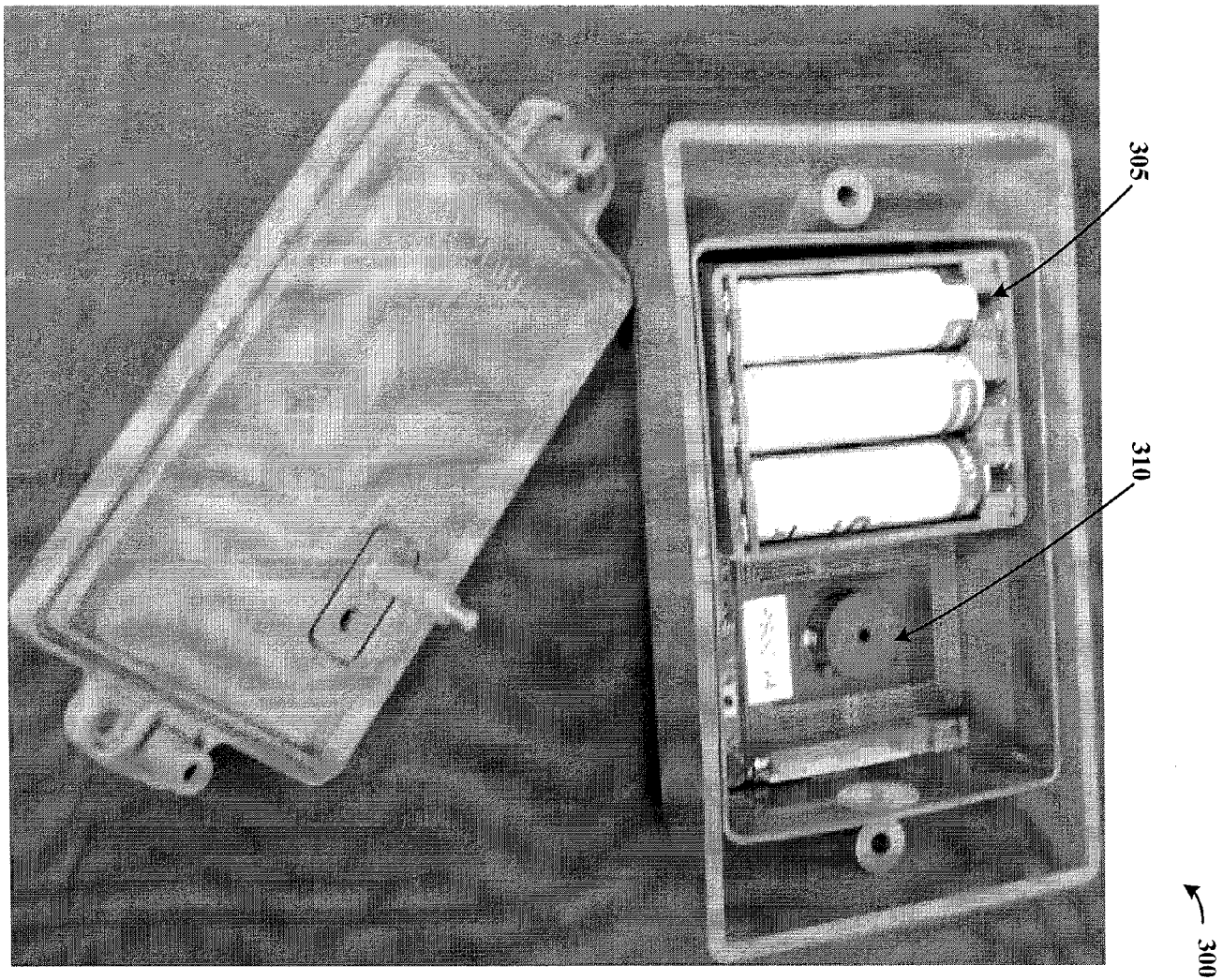
FIG. 3 shows the inside of a contactless card reader, according to an example embodiment of the present invention.

FIG. 3 shows the inside of a contactless card reader 300, according to an example embodiment of the present invention. The contactless card reader 300 includes a battery circuit 305 and an antenna/coil 310 that energizes the antenna/coil of a contactless card when the card reader detects the presence of the card.

Figure 4:
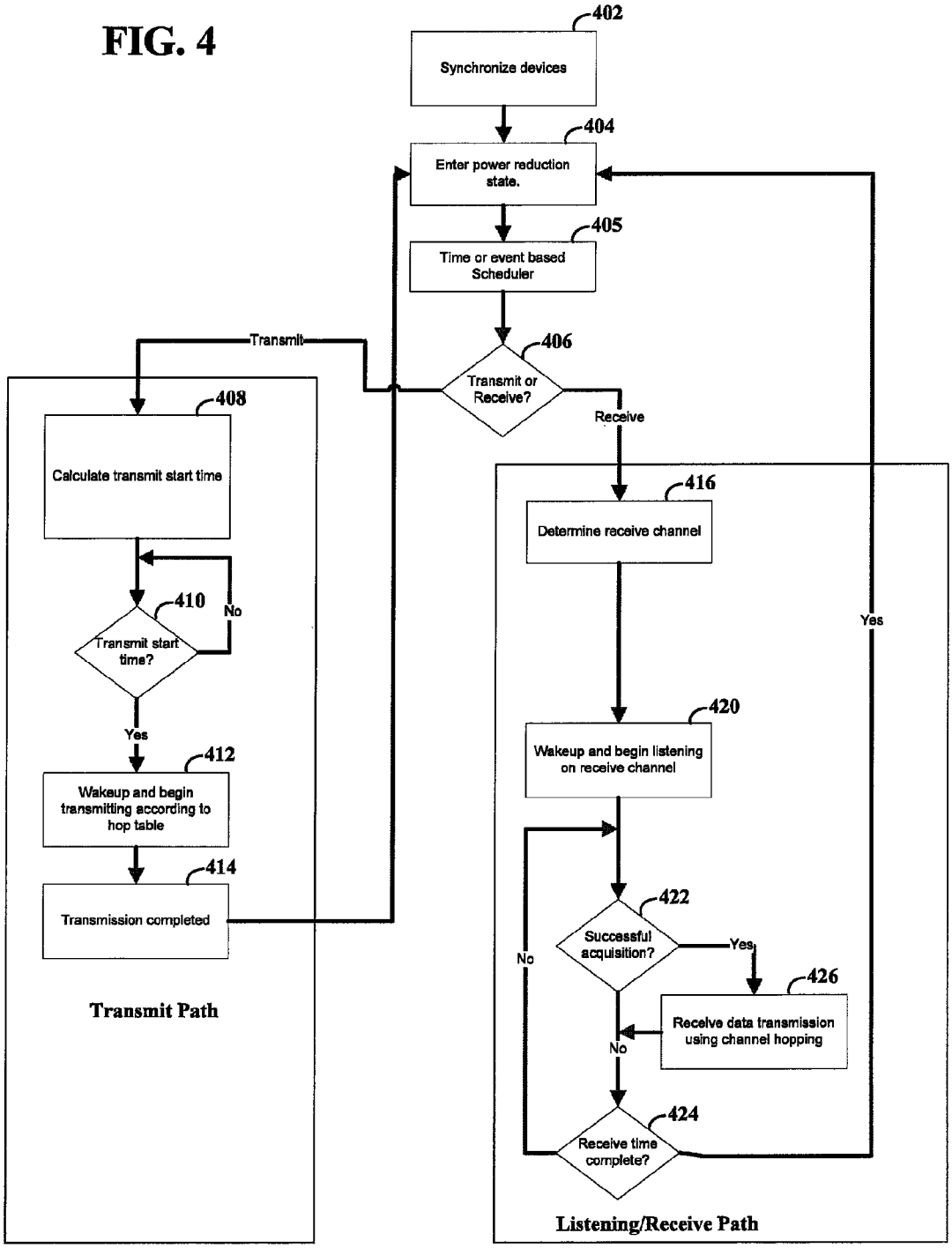
FIG. 4 shows a flow chart for a method of communication between communication devices in a building-security system, according to another example embodiment of the present invention.

FIG. 4 depicts an example method according to another embodiment of the present invention. The method of FIG. 4 may be implemented using two or more wireless devices for a building-security system. The devices synchronize with respect to each other or an independent time source as depicted at block 402. This synchronization step is shown as the first step in the process; however, the devices may synchronize after one or more transmissions, or they may synchronize periodically.

When the devices are not actively transmitting, receiving or listening, they are typically in a power reduction state as depicted by block 404. A scheduler determines that the device will begin transmitting or listening/receiving based upon time-based or event-based criteria as shown by block 405. In response to determining that the device will begin transmitting or listening/receiving, the device begins either the transmit path or receiving path as depicted by the decision block 406. The device typically makes the determination based upon the configuration of the building-security system and the communication protocols. For example, a peripheral device may determine that it will begin transmitting upon receiving information from a sensor or other input, such as a window sensor being triggered. The control panel or peripheral may periodically determine that it will begin listening for any information transmitted from the other devices. Alternatively, a device may determine that it will begin listening/receiving for a response to a previous communication. Other examples of factors used in the determination include the need for synchronization messages, configuration of peripherals and requests for repeating corrupted data.

A transmitting device follows the transmit path to effect a transmission to another device. Prior to transmitting, the transmitting device calculates the transmit start time as shown at block 408. In one embodiment, the transmit start time is a function of the expected listening channel of the receiving device and the transmission period. In a more specific embodiment, the transmit start time may be calculated based upon the number of channels in a frequency sequence (frequency-hop table) between the current transmitting channel and the expected listening channel of the receiving device and the expected listening time the receiving device will begin listening on the expected listening channel (receive activation time).

As shown at block 410, the transmitting device determines whether the transmit start time has been met. The transmitting device bases the determination by, for example, a comparison of the transmit start time and the current time. Until the transmit time has been met, the transmitting device remains in the power reduction state. Once the transmit time has been met, the transmitting device enters a transmitting state and begins wireless transmissions as depicted in block 412. The transmitting device determines the transmission frequency using the frequency-hop table.

Typically, the receiving device recognizes the wireless transmission, and upon a successful acquisition phase, begins to track the transmitting device. The transmitting device then proceeds to transmit the desired message/data to the receiving device. Upon completion of the transmission as depicted in block 414, the transmitting device returns to the power reduction state as shown in block 404 and the process is repeated.

Similarly, a receiving device follows the listen/receive path to receive a transmission from another device. The receiving device first determines what channel to begin listening for a transmission as shown in block 416. This determination may be a known value stored in a local memory or an output provided from a circuit. Alternatively, the determination may be based upon other variable factors, such as a previous transmission time or data received from an input of the receiving device.

Typically, the receiving device will stay in the power reduction mode until the activation time. At or near the activation time, the receiving device leaves the power reduction mode to enable the receiving device for the receipt of a transmission as depicted in block 420. The receiving device then continues to listen for a transmission until one of two conditions is met. The first condition is depicted by block 422 and represents the successful receipt and acquisition of a transmission from another device. The second condition is depicted by block 424 and represents a specified time frame during which the receiver is to remain active. If the receiving device determines that the second condition has been met, the receiving device returns to the power reduction state shown in block 404; however, if the receiving device determines that the first condition has been met, the transmission is received from the transmitting device as shown in block 426. Upon completion of the transmission, the receiving device resumes listening, unless the specified time frame of block 424 has been completed. If the time frame has been completed, the device returns to the power reduction state shown in block 426.

In one embodiment, one or more of the devices may only be capable of transmitting, and one or more of the devices may only be capable of receiving. Such devices would follow only the transmission or receiving path, respectively. In other embodiments the devices are capable of both transmitting and receiving and would follow the appropriate path.

Figure 5:
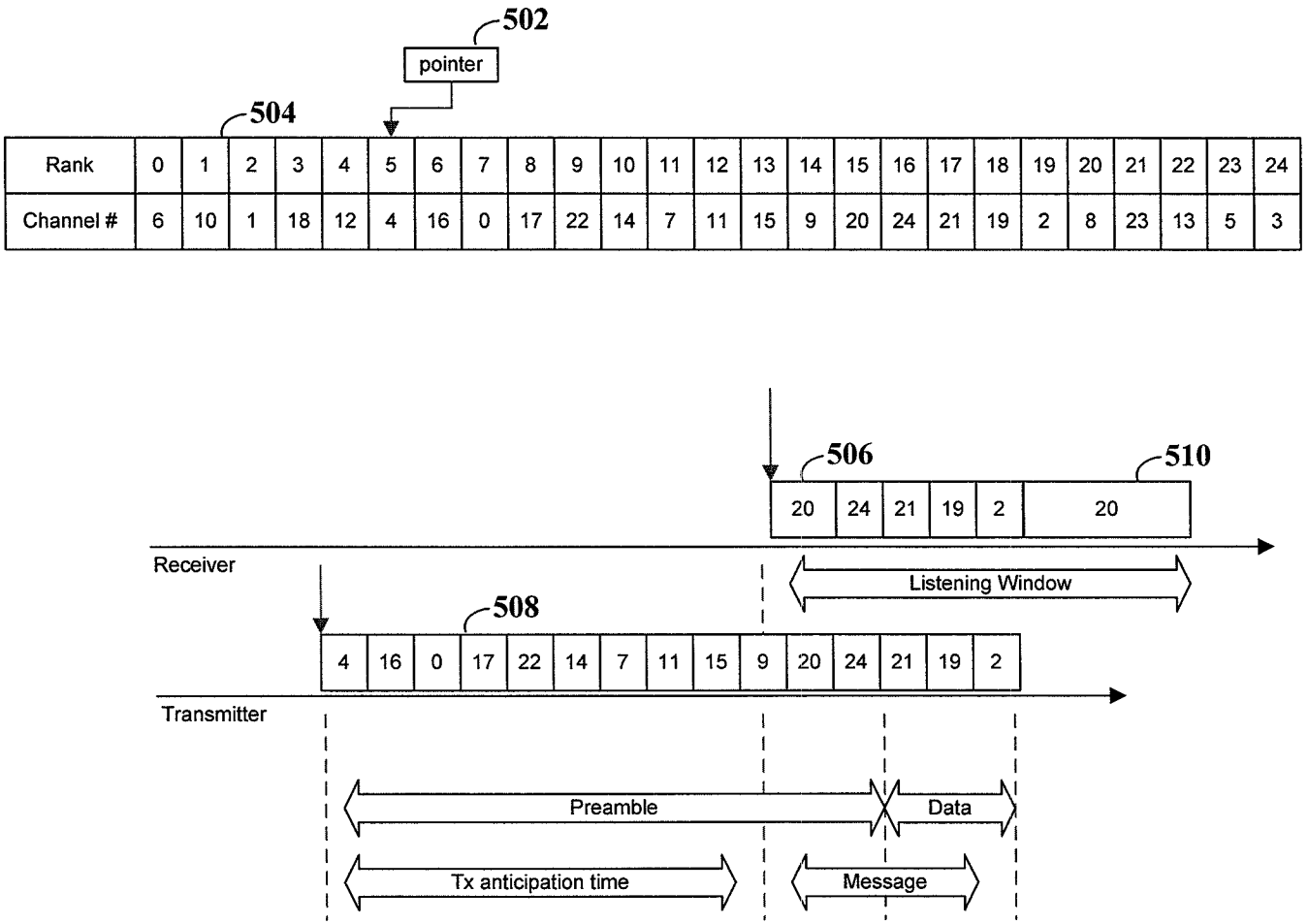
FIG. 5 shows an implementation of a transmit anticipation time and frequency-hop table, according to another example embodiment of the present invention.

FIG. 5 shows an implementation of the transmit anticipation time and frequency-hop table, according to another example embodiment of the present invention. The figure depicts frequency-hop table 504, its pointer 502 and the receiver and transmitter timelines.

Frequency-hop table 504 represents an order of frequency channels used by both the receiver and the transmitter to communicate. To increase security, decrease data loss and conform to (FCC) regulations, the order of the channels is typically pseudo-random. For instance, table 504 shows ranks 0-25 in the top row of the table. These ranks reflect the order of the channels used by the devices and correspond to the channel in the lower row of the table. The communicating devices would use the channels in the order provided. Thus, table 504 may be used in applications using frequency-hopping spread spectrum or similar techniques.

Pointer 502 represents the current channel to be used by the transmitting device. More specifically, a transmitting device begins transmitting according to the channel indicated by the pointer. In one embodiment, this channel represents the last channel used by the transmitting device or the channel immediately following the last channel used. This use of the pointer by a transmitting device ensures that the channels are utilized equally because the transmitting devices transmit according to the frequency-hop table.

The receiver and transmitter timelines depict the channels used by a receiver and transmitter as a function of time. In this example, time increases from left to right. The receiver begins listening at the start of the Rx activation as shown by the arrow and block 506. This represents the time at which the receiver is listening for a transmission from the transmitter. In this instance, the receiver is listening to channel 20, which corresponds to rank 15 of table 504.

The transmitter timeline depicts the transmitter beginning to transmit at the start of the Tx anticipation time as shown by the arrow at the start of the Tx anticipation time and block 508. The transmitter begins transmitting on the channel that corresponds to the pointer 502. In this instance, the pointer indicates rank 5 and channel 4. The transmitter changes frequency according to the wireless communications protocol being implemented and the table 504 as shown by block 508. The Tx anticipation time is the time the transmitter begins transmitting in relation to the Rx activation time. The Tx anticipation time is selected so that, during the Rx activation time, the transmitter is transmitting on the same channel to which the receiver is listening. If frequency-hopping spread spectrum is used, the Tx anticipation time is a function of the current rank determined by pointer 502 and the Rx activation channel of the receiver. More specifically, the anticipation time is calculated using the number of the channels in table 504 between the current rank and the Rx activation channel. This number is multiplied by the time the transmitter is active on any one channel (dwell time) plus the time required to switch to a new time (blank time).

During the Tx anticipation time the transmitter sends preamble frames as shown by the transmitter timeline from channel 4 to channel 9. After the transmitter reaches the transmit anticipation time it transmits a preamble frame using the listening channel followed by the remainder of the message. The receiving device acquires the transmitter using the preamble frame and tracks the transmitter according to the frequency hop table, as shown on the receiver timeline. In an alternate embodiment, the transmitter transmits one or more preamble frames after the preamble frame transmitted using the listening channel. For example, FIG. 5 depicts preamble frames transmitted on the listening channel (20) and a subsequent channel (24). Using this method, the number of preamble frames can be increased so as to improve quality of the acquisition phase between the transmitter and the receiver.

The receiver continues listening on the channel until the listening window is over as shown by block 510. In some instances, the listening window may only be long enough to receive a single message resulting in a short active time of the receiver to saving power. For such instances, the listening shown by block 510 is not implemented. In other instances, the listening window may be longer to accommodate several messages, or devices which are not synchronized. For example, the control panel often requires a longer listening window because devices such as keyfobs lose synchronization.

In an alternate embodiment, the pointer can represent the last channel used by the receiving device or the channel immediately following the last channel used by the receiving device. For example, the control panel can implement a pointer for each peripheral device. When the control panel wishes to communicate with a receiving peripheral, the control panel begins transmitting on the channel indicated by the pointer that corresponds to the receiving peripheral. After a completed transmission, the control panel and the peripheral devices will use the next channel in the frequency-hop table. This use of pointers also ensures equal utilization of channels because the transmitter transmits according to the frequency-hop table for each peripheral. This embodiment is particularly useful for situations where the transmitting device is the only device that transmits to the receiving device as can sometimes be the case in a system where a control panel transmits to peripheral devices. Accordingly, an alternate scheme can be used for a peripheral device transmitting to a control panel.

Consistent with this embodiment, the transmitting device does not calculate a transmission anticipation time. Instead, the transmitting device begins transmitting on the channel indicated by the pointer at the Rx activation time because the first transmitting channel is the same as the receiving channel. Other methods can be used to determine the starting transmission channel. For example, the receiving channel can be periodically changed for each receiving device and the pointers at the transmitting device are changed accordingly. In some instances, transmissions using channels that have not been used equally can be added to balance the use of the channels or the control panel can periodically send information to control the use of listening channels by the peripherals.

The various circuits and logic described herein can be implemented using a variety of devices including, but not limited to, discrete logic components, analog components, general purpose processors configured to execute software instructions, programmable logic devices and combinations thereof.

While certain aspects of the present invention have been described with reference to several particular example embodiments, those skilled in the art will recognize that many changes may be made thereto without departing from the spirit and scope of the present invention. Aspects of the invention are set forth in the following claims.

What is claimed is:

1. A security system comprising:

a card including a transponder circuit to transmit data responsive to an energize signal;

a contactless card reader for receiving data transmitted by the card, the contactless card reader including a scheduler configured and arranged to generate an output in response to determining that the contactless card reader is to begin transmitting;

a controller communications circuit configured and arranged to respond to the output from the scheduler by calculating a transmit start time based upon a number of channels in a frequency-hop table between a current transmitting channel and an expected listening channel of a receiving device and an expected listening time that the receiving device is expected to begin listening on the expected listening channel, and starting a transmission based upon the determined transmit start time;

a card energizing circuit for producing the energize signal, a battery circuit for powering the controller communications circuit and the card energizing circuit, and a power-control circuit to control use of the battery circuit in response to card proximity, wherein the contactless card reader is configured to store a log of access requests and to transmit the log of access requests at predetermined intervals that correspond to the output from the scheduler; and a controller that controls arming and disarming of the security system based on data wirelessly transmitted by the communications circuit and wherein the controller is configured and arranged to wirelessly communicate with multiple peripheral devices.

2. A card configured for use in the security system of claim 1.

3. A contactless card reader configured for use in the security system of claim 1.

4. For use in a security system that uses a controller to communicate with security-monitoring devices, a contactless card reader comprising:

a circuit for wirelessly interfacing with the controller by determining a transmit start time based upon a number of channels in a frequency-hop table between a current transmitting channel and an expected listening channel of the controller and an expected listening time that the controller is expected to begin listening on the expected listening channel, and starting a transmission based upon the determined transmit start time;

a battery circuit;

a sensor for detecting a contactless card;

a power-control circuit, responsive to the sensor, to control use of the battery circuit; and a coil for energizing the contactless card in response to the contactless card being detected by the sensor, the contactless card transmitting data to the contactless card reader in response to being energized;

wherein, responsive to the data transmitted by the contactless card, the contactless card reader wirelessly interfaces with the controller, the controller arming or disarming the security system based on the data transmitted by the contactless card.

5. The contactless card reader of claim 4, wherein the data transmitted by the contactless card is a unique identification code that identifies an authorized user.

6. The contactless card reader of claim 4, further comprising a memory that stores identification codes of authorized users, wherein the data transmitted by the contactless card is a unique identification code that identifies an authorized user and the contactless card reader verifies the unique identification code by comparing it to the identification codes stored in the memory, and wherein the controller arms or disarms the security system responsive to the verification.

7. The contactless card reader of claim 4, wherein the data transmitted by the contactless card is a unique identification code that identifies an authorized user and wherein the card reader wirelessly transmits the unique identification code to the controller, which verifies the unique identification code and arms or disarms the security system responsive to the verification.

8. The contactless card reader of claim 4, wherein the controller opens a gate to allow access to the secured area in response to the data transmitted by the contactless card.

9. The contactless card reader of claim 4, wherein the data transmitted by the contactless card is a unique identification code that identifies an authorized user and the contactless card reader wirelessly transmits the unique identification code to the controller, and wherein the controller instructs a camera to capture an image of a person at the contactless card reader, the controller compares the captured image to an image of the authorized user identified by the unique identification code, and the controller arms or disarms the security system in response to the captured image matching the image of the authorized user.

10. The contactless card reader of claim 4, wherein the sensor is a capacitive sensor that detects the mass of the contactless card.

11. The contactless card reader of claim 4, wherein the power-control circuit activates the contactless card reader only when a contactless card is detected by the sensor.

12. A method for arming or disarming a security system that uses a controller to communicate with security-monitoring devices and a battery powered contactless card reader, the method comprising:

detecting the presence of a contactless card by the contactless card reader;

activating the contactless card reader in response to detecting the contactless card;

energizing a coil of the contactless card by the activated contactless card reader;

transmitting data from the contactless card to the contactless card reader in response to energizing the coil;

verifying the data transmitted by the contactless card;

wirelessly interfacing the contactless card reader with the controller to arm or disarm the security system responsive to the verification by determining a transmit start time based upon a number of channels in a frequency-hop table between a current transmitting channel and an expected listening channel of the controller and an expected listening time that the controller is expected to begin listening on the expected listening channel; and wirelessly transmitting a log of access requests to the controller at predetermined intervals.

* * * * *